US005444950A

United States Patent [19]

Kelly et al.

[11] Patent Number: 5,444,950

[45] Date of Patent: Aug. 29, 1995

[54] DRAINAGE SYSTEM FOR BUILDING FOUNDATIONS

[76] Inventors: Chad M. Kelly; Rodney J. Kelly, both of 5011 N. 10th St., Marion, Iowa 52302

[21] Appl. No.: 997,335

[22] Filed: Dec. 28, 1992

[51] Int. Cl.[6] ..... E02D 19/00

[52] U.S. Cl. ..... 52/169.5; 405/43; 405/50; 52/712

[58] Field of Search ..... 52/143, 169.5, 712, 52/698; 405/43, 45, 50

[56] References Cited

U.S. PATENT DOCUMENTS

| | | | |
|---|---|---|---|
| 3,656,268 | 4/1972 | Murati | 52/169.5 |
| 4,045,964 | 9/1977 | Barclay | 52/169.5 X |
| 4,074,684 | 2/1978 | Biesel | 52/169.5 X |
| 4,136,500 | 1/1979 | DiFiore | 52/169.5 X |
| 4,865,069 | 9/1989 | Lacey | 52/169.5 X |
| 4,925,342 | 5/1990 | Hendy | 52/169.5 X |
| 5,017,042 | 5/1991 | Minor et al. | 52/169.5 X |
| 5,035,095 | 7/1991 | Bevilacqua | 52/169.5 |
| 5,056,281 | 10/1991 | McCarthy | 52/169.5 |
| 5,149,227 | 9/1992 | Parks | 405/50 X |
| 5,190,404 | 3/1993 | Kiyokawa et al. | 52/169.5 X |

FOREIGN PATENT DOCUMENTS

| | | | |
|---|---|---|---|
| 3220881 | 4/1983 | Germany | 52/169.5 |

OTHER PUBLICATIONS

System Platon By ISOLA—Sales Brochure, Apr.-88 and installation instructions.

TerraDrain Drainage Systems—Sales Brochure 6/90.

SpecData by Greenstreak, Inc.—Sales Brochure.

GeoTech Systems Corproation—Sales Brochure—1989.

*Primary Examiner*—Peter M. Cuomo

*Assistant Examiner*—Suzanne L. Dino

*Attorney, Agent, or Firm*—James C. Nemmers

[57] ABSTRACT

A drainage system for minimizing the problems resulting from the effects of ground and surface water on below grade structures such as building foundations. The system utilizes horizontal drain pipes extending along the exterior of the foundation wall and vertical perforated drainage pipes which carry the water to the horizontal pipes, the vertical pipes being placed at spaced intervals along the foundation wall to drain the ground water into the horizontal drain pipe.

4 Claims, 1 Drawing Sheet

DRAINAGE SYSTEM FOR BUILDING FOUNDATIONS

BACKGROUND OF THE INVENTION

Problems associated with ground and surface water and below grade structures are well known. Such structures as below-grade foundation walls or highway or landscaping retaining walls are subject to hydrostatic pressure from ground water and surface water. If the water level rises in the soil outside of a foundation wall for example, hydrostatic pressure will be exerted on the wall and the floor enclosed by the foundation wall as the water attempts to rise to the same level inside of the foundation as the level outside. If the water cannot get through the floor and wall, the hydrostatic pressure exerted on both the floor and wall causes increased loading and deflection on both the wall and floor which may have not been designed for such loading. Moreover, leakage can occur through any cracks, joints or irregularities in the wall and the foundation footings, and if the hydrostatic pressure is not relieved, it eventually will penetrate up through cracks and joints in the floor and walls and into the interior of the structure. To design walls and floors for residential foundations and basements sufficiently strong so as to resist this hydrostatic pressure is usually not practical because of the cost. Therefore, there have been developed and are known methods for preventing the build up of hydrostatic pressure from ground and surface water.

One of the most common and cost effective ways to relieve hydrostatic pressure is to install drains around the foundation walls at or above the footings and connect these drains to a sump system. These drains commonly are perforated pip which are then surrounded with a layer of drainage aggregate to prevent the soil from plugging the drainage openings in the pipe. However, these drainage tiles can become overloaded from excess surface water which cannot filter down through the soil. This is especially true where there is a high ground water level and thus the surface water cannot continue to drain down through the soil.

In an effort to improve these drainage systems, there are known a number of different products and systems. One commonly used system is to apply to the exterior of the foundation wall a membrane usually made of high density polyethylene. The membrane is typically spaced from the wall and anchored to the foundation wall in a variety of ways. Depending upon the particular installation, these membranes may be sealed or not sealed, but they do provide a gap which serves as a drainage corridor should the membrane be punctured. In either event, the membrane provides a barrier to keep the water and thus the hydrostatic pressure from the foundation wall. In some installations, filter strips can be added by spacing the strips along the soil-side of the membranes, which strips will absorb surface water and carry it downwardly into the drainage aggregate surrounding the drain pipe.

Other variations of the membrane system are to apply a fabric backing to the membrane that contacts the wall to absorb moisture from the wall. In these installations, the membrane is sealed to provide an air corridor between it and the wall, but if the membrane is punctured, the system is rendered less effective.

There are also known and used insulated drainage boards or panels which are solid layers of material placed against the exterior of the foundation wall.

These drainage panels typically have a layer of filter fabric in contact with the wall, a drainage board layer which absorbs and carries moisture and a vapor retarder on the exterior of the panels. These solid panels have the advantage that they will not puncture or deform during backfilling operations, and they also have insulating value.

However, all of the known products and methods use materials that are quite expensive and require considerable labor to install. As a result, most residential contractors, to keep the price of their houses competitive, will not use these improved drainage systems. Because of their relatively high cost, these prior art systems are principally used in building structures where they are specified by the owner or architect, or in commercial installations where the added cost is not a major factor.

In addition, many of these prior art products are not resistant to a number of petroleum based products which are frequently used as waterproofing or damp proofing materials on the exterior of the foundation before the application of the drainage systems. Not infrequently, the composition of the surrounding soil may have a deteriorating effect over a period of time on the materials, thus shortening their useful life.

There is therefore a need for an improved drainage system that is not only effective but low in cost so that it can be used for residential as well as other more costly structures without adding much to the cost of construction.

There is a further need for an improved drainage system that is easy to install, can be installed by unskilled labor, and which will not be adversely affected by backfilling operations, soil conditions, or waterproofing compounds.

SUMMARY OF THE INVENTION

The improved drainage system of the invention includes drainage pipes extending horizontally along the outside of the foundation or other wall to be protected, combined with vertical drainage pipes containing perforations that allow surface or ground water to be quickly carried off to the horizontal drainage pipes thereby preventing a build-up of hydrostatic pressure. The vertical drain pipes are located at spaced intervals around the exterior of the below grade wall, and in the preferred embodiment, are quickly and easily fastened to the wall with simple plastic ties attached to the metal ties extending from the foundation wall after the concrete forms have been removed.

DESCRIPTION OF THE PREFERRED EMBODIMENT OF THE INVENTION

Figure 1:
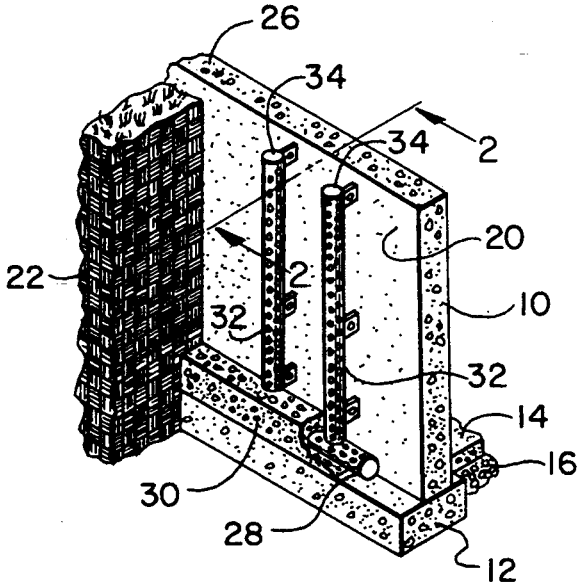
FIG. 1 a perspective view of a portion of a foundation wall and footing and showing the drainage system of the invention.
Figure 2:
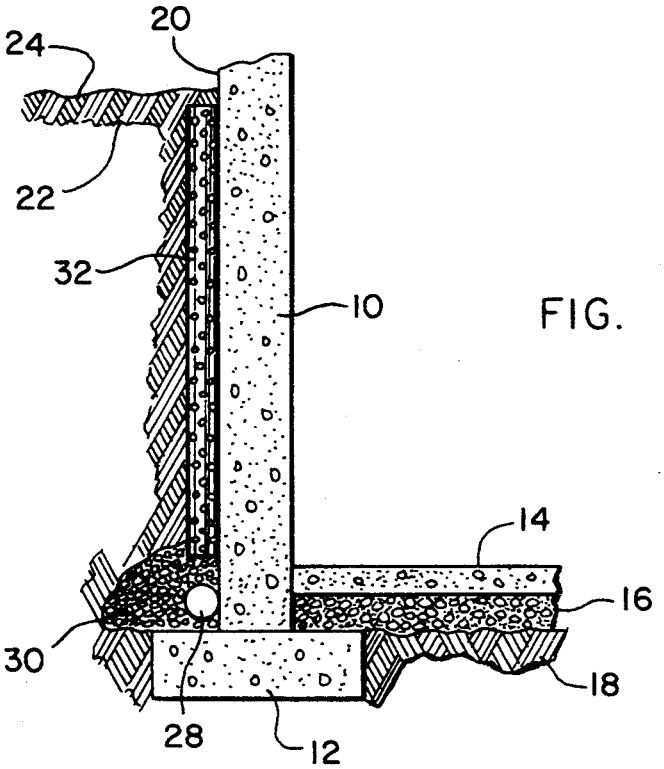
FIG. 2 is a sectional view taken on the line 2—2 of FIG. 1 and further illustrating the drainage system of the invention.

In FIGS. 1 and 2, there is illustrated a concrete foundation wall 10 that rests on a concrete footing 12. Only a portion of a typical wall and footing is shown for purposes of illustration, but it will be understood that normally the foundation wall 10 encloses an interior space of either a regular or irregular configuration and functions as a support as well as wall for the lower level of a structure. In most applications, such as residential or commercial structures, the concrete footing 12 also supports a poured concrete floor 14 for the interior space, and the floor 14 typically rests upon a layer of aggregate 16. Beneath the aggregate 16 and the footing 12 is the earth 18 on which the structure is built.

Also, after the foundation wall 10, footing 12 and drainage system have been constructed, the exterior surface 20 of the wall 10 is typically covered with a waterproofing compound and then earth 22 is backfilled up to a finished grade 24 which is generally below the top surface 26 of the wall 10.

Also, it will be understood by those skilled in the art, that the foundation wall 10 is most commonly constructed by pouring concrete between forms (not shown), such as the commonly used aluminum forms. These forms may have an inside surface that produces a decorative surface on the exterior surface 20 of the foundation wall 10 that resembles a brick-mortar construction, for example. It will also be understood by those skilled in the art that the concrete forms used are held together by metal ties at spaced intervals so as to prevent the forms from spreading apart during the pouring and curing of the concrete. When the forms are removed, these ties remain embedded in the concrete wall, and they are cut off flush with the interior surface of the foundation wall, but the portions of these ties that extend out from the exterior surface 20 below grade are normally left in place. It should be further understood by those skilled in the art that the foundation wall 10 may also be constructed of masonry blocks or bricks.

As previously explained, both surface and ground water produce hydrostatic pressure on the foundation wall 10, footing 12 and floor 14. Unless relieved, this hydrostatic pressure can cause cracking and buckling of the wall 10 and floor 14, and also can cause penetration of the water up through the joints between the wall 10, footing 12 and floor 14. Over even a relatively short period of time, the hydrostatic pressure can be sufficiently great to produce structural failure. In practically all instances, the hydrostatic pressure can force water inside the structure, which is obviously undesirable.

Footing drains have been used for many years in an attempt to carry away surface or ground water and thus prevent the build up of hydrostatic pressure on the wall 10 and floor 12. FIGS. 1 and 2 show these drains in the form of perforated drain pipes 28 which are placed commonly either on top of or along the side of the footing 12 adjacent the exterior surface 20 of the foundation wall 10. These drain pipes 28 are commercially available and of different materials and different diameters, and are made of plastic composition material that is highly resistant to any of the soil conditions and are unaffected by freeze-thaw cycles. Also, as is well known, the drain pipe 28 is covered by a layer of aggregate 30, and the pipe 28 is commonly connected to a sump system (not shown) to drain the water away from the structure and into a storm sewer system, for example.

Extending down to the horizontal drain pipe 28 are a plurality of vertically extending drain pipes 32 which are also perforated and preferably of a diameter equal to or smaller than the diameter of the drain pipe 28. The vertical drain pipes 32 are spaced around the exterior surface 20 of the wall 10 at desired intervals, usually a maximum of two feet apart. The vertical drain pipes 32 are attached to the foundation wall 10 in any suitable manner. If the foundation wall 10 is poured concrete, the ends of the form ties (not shown) that extend outwardly from the surface 20 can be used as anchors for plastic or other ties of a quick connect type. This makes installation of the vertical drain pipes 32 quick and easy since only two or three ties are necessary to support the vertical pipes 32 until the soil 22 is backfilled around the foundation wall 10. Also, caps 34 are placed in the top of the drain pipes 32 to prevent them from becoming plugged with the earth 22 during backfilling. If no form ties are available for connecting the drain pipes 32 to the foundation wall 10, concrete nails can be driven into the wall 10 and used as anchors to secure the drain pipes 32 with suitable quick connect ties.

The pipes 32 are preferably of material that is resistant to soil and other conditions. Such pipes are commercially available, already perforated. Also, any suitable water proofing material can be first applied to the exterior surface 20 of the foundation wall 10 before installation of the pipes 32.

The pipes 32 extend downwardly toward the drain pipes 28 with the lower end of each pipe 32 resting on the layer of aggregate 30 covering the drain pipes 28. If there is no aggregate layer, the lower ends of the pipes 32 can rest directly on top of the drain pipes 28.

Obviously, the drainage system of the invention utilizes relatively inexpensive materials that are quickly and easily installed. The system thus becomes readily available for use for almost all structures, including residential structures, for a relatively nominal cost. By allowing surface and ground water to enter the vertical stand pipes 32 from where it is carried downwardly into the drain pipes 28 and drained to grade or to a sump system, hydrostatic pressure is not allowed to build up around the foundation wall 10, footing 12, and floor 14. Unlike some of the prior art systems, there is no concern about damage or perforation to a membrane, nor are there problems of sealing the tops of the membrane or seams between sections of the membrane. If the drain pipes 32 become partially crushed or perforated, the effectiveness of the system of the invention is not affected. Installation of the system of the invention is quick and easy, and can be accomplished in approximately four to five man hours for the foundation wall of a typical residential structure. Transportation and storage of the materials to the job site is easy, since the materials used for the pipes 28 and 32 are lightweight and not bulky. By the use of the ties remaining from the metal forms used in pouring the concrete foundation wall 10, no mechanical fastening of the drain pipes 32 to the wall 10 is necessary. Moreover, after installation of the system of the invention and before backfilling takes place around the foundation wall 10, the installation can be quickly and easily inspected and checked.

The system of the invention thus provides a permanent and improved drainage system that will eliminate hydrostatic pressure and the problems resulting from it around foundation walls and other below grade structures. Moreover, little or no training of installers is necessary since use and installation of the perforated drain pipe 28 is already commonly known and done, and there is no concern about sealing of seams, protection of the system from damage or puncture, etc.

Although the system of the invention has been described in connection with a preferred embodiment thereof, it will be evident to those skilled in the art that various revisions and modifications can be made to the preferred embodiment without departing from the spirit and scope of the invention. It is my intention, however, that all such revisions and modifications as are obvious to those skilled in the art will be included within the scope of the following claims.

What is claimed as follows:

1. A drainage system for draining surface and groundwater from a substantially vertical structure that extends beneath the surface of the ground and which has an exterior surface in contact with the ground, said drainage system comprising: a drain pipe extending substantially horizontally along the structure at a level beneath the ground surface, said drain pipe having a plurality of openings for receiving the water to be drained, and a plurality of individual vertically extending drain pipes located at selected spaced intervals along and near the exterior surface of the structure, each of the vertically extending drain pipes being independently installed along the exterior surface of the structure and each pipe having a plurality of openings throughout its entire length for receiving the water to be drained from the ground surrounding the pipe, and each of the vertically extending drain pipes extending from a point beneath the ground surface to a point above the horizontally extending drain pipe.

2. The drainage system of claim 1 in which there is a layer of aggregate around the horizontally extending drain pipe, and the vertically extending drain pipes extend down to the layer of aggregate.

3. The drainage system of claim 1 in which the structure is a poured concrete wall having form ties extending from the exterior surface, and means is provided for securing the vertically extending drain pipes to the wall, which means includes said form ties.

4. The drainage system of claim 2 in which the spaced intervals of the vertically extending drain pipes is a maximum of two feet.

* * * * *